US011788192B2

(12) United States Patent
Renaud et al.

(10) Patent No.: US 11,788,192 B2
(45) Date of Patent: Oct. 17, 2023

(54) INHIBITORS OF METAL CORROSION

(71) Applicant: ARKEMA FRANCE, Colombes (FR)

(72) Inventors: Lionel Renaud, Octeville sur Mer (FR); Bernard Monguillon, Nogent sur Marne (FR); Jean-Alex Laffitte, Biarritz (FR); Denis Siguret, Oullins (FR); Pierre Mekarbane, Chaponost (FR)

(73) Assignee: ARKEMA FRANCE, Colombes (FR)

( * ) Notice: Subject to any disclaimer, the term of this patent is extended or adjusted under 35 U.S.C. 154(b) by 192 days.

(21) Appl. No.: 16/643,098

(22) PCT Filed: Aug. 30, 2018

(86) PCT No.: PCT/FR2018/052128

§ 371 (c)(1),
(2) Date: Feb. 28, 2020

(87) PCT Pub. No.: WO2019/043340

PCT Pub. Date: Mar. 7, 2019

(65) Prior Publication Data

US 2020/0199764 A1 Jun. 25, 2020

(30) Foreign Application Priority Data

Sep. 1, 2017 (FR) ..... 1758100

(51) Int. Cl.

| | |
|---|---|
| ***C23F 11/04*** | (2006.01) |
| ***C23G 1/04*** | (2006.01) |
| ***C23F 11/14*** | (2006.01) |
| ***C23F 11/18*** | (2006.01) |

(52) U.S. Cl.

CPC ..... *C23F 11/04* (2013.01); *C23F 11/147* (2013.01); *C23F 11/182* (2013.01); *C23G 1/04* (2013.01)

(58) Field of Classification Search

None

See application file for complete search history.

(56) References Cited

U.S. PATENT DOCUMENTS 4,439,338 A * 3/1984 Tomaiuolo ..... C23F 1/44 510/499
4,521,591 A * 6/1985 Jan ..... C09B 35/02 430/431

(Continued)

FOREIGN PATENT DOCUMENTS

CN 1224775 A 8/1999
CN 1715450 A 1/2006

(Continued)

OTHER PUBLICATIONS

Tsuhua et al. Introduction to Fine Chemical Engineering, Chemical Industry Press, Jul. 2005, pp. 233-234 (Chinese).

(Continued)

*Primary Examiner* — Joseph D Anthony
(74) *Attorney, Agent, or Firm* — Smith, Gambrell & Russell, LLP; Dennis C. Rodgers; Ram W. Sabnis

(57) ABSTRACT

The present invention relates to a composition of at least one sulfonic acid in combination with an effective amount of at least one nitrosyl compound, acting as inhibitor of corrosion of metals by said at least one sulfonic acid.

13 Claims, 1 Drawing Sheet

(56) References Cited

U.S. PATENT DOCUMENTS

| | | | | |
|---|---|---|---|---|
| 5,280,128 | A * | 1/1994 | Bauer | C09B 57/14 564/426 |
| 6,120,619 | A * | 9/2000 | Goudiakas | C23C 22/50 422/12 |
| 8,901,060 | B2 | 12/2014 | Faßbender et al. | |
| 2004/0033190 | A1 | 2/2004 | Suty | |

FOREIGN PATENT DOCUMENTS

| | | | |
|---|---|---|---|
| CN | 101607765 | A | 12/2009 |
| CN | 104611712 | | 5/2015 |
| DE | 10 2004 045 297 | A1 | 3/2006 |
| EP | 0 077 582 | | 4/1983 |
| EP | 0 931 854 | A1 | 7/1999 |
| FR | 1 012 474 | A | 7/1952 |
| FR | 2 453 912 | A1 | 11/1980 |
| GB | 2048311 | A | 12/1980 |
| JP | H07-278854 | A | 10/1995 |
| KR | 10 2001 0017236 | A | 3/2001 |
| WO | 02/46095 | A1 | 6/2002 |
| WO | 2010/055160 | A2 | 5/2010 |

OTHER PUBLICATIONS

Korean Office Action dated Aug. 8, 2021 for Korean Patent Application No. 10-2020-7005830 (5 pages in Korean with English Translation).

International Search Report for PCT/FR2018/052128, dated Nov. 19, 2018 (6 pages with English translation).

Written Opinion for PCT/FR2018/052128, dated Nov. 18, 2018 (7 pages).

Chinese Search Report dated May 20, 2021 received in Chinese Patent Application No. 201800562838 (2 pages).

First Office Action dated May 31, 2021 received in Chinese Patent Application No. 201800562838 (5 pages in Chinese with translation).

Second Office Action dated Nov. 29, 2021 received in Chinese Patent Application No. 201800562838 (5 pages in Chinese with translation).

International Preliminary Report on Patentablity dated Mar. 3, 2020 for Internationoal Patent Application No. PCT/FR2018/052128 (8 pages in French with English translation).

Qi, J.S., et al. Corrosion of Stainless Steel During Acetate Production. Corrosion Engineering, 1996, vol. 2, No. 7, pp. 558-565.

Cètre, Y. Prévention et lutte contre laè corrosion. Chapitre 26. Corrosion Dans L'Industrie Chimique: Influence de Certaines Espèces sur les Phénomènes de Corrosion des Matériaux Métalliques dans Différents Milieux. 2004. Presses Polytechniques et Universitaires Romandes. pp. 661-676.(In French with machine translation).

Gaur, B., et al. Corrosion of metals and alloys in methane sulphonic acid. British Corrosion Journal. 1999, vol. 34, No. 1, pp. 63-66.

Chemical Abstracts, Abstract No. 117933-98-9 (3 pages).

Korean Office Action dated Jun. 25, 2023 for Korean Patent Application No. 10 2020 7005830 (5 pages in Korean with English Translation).

* cited by examiner

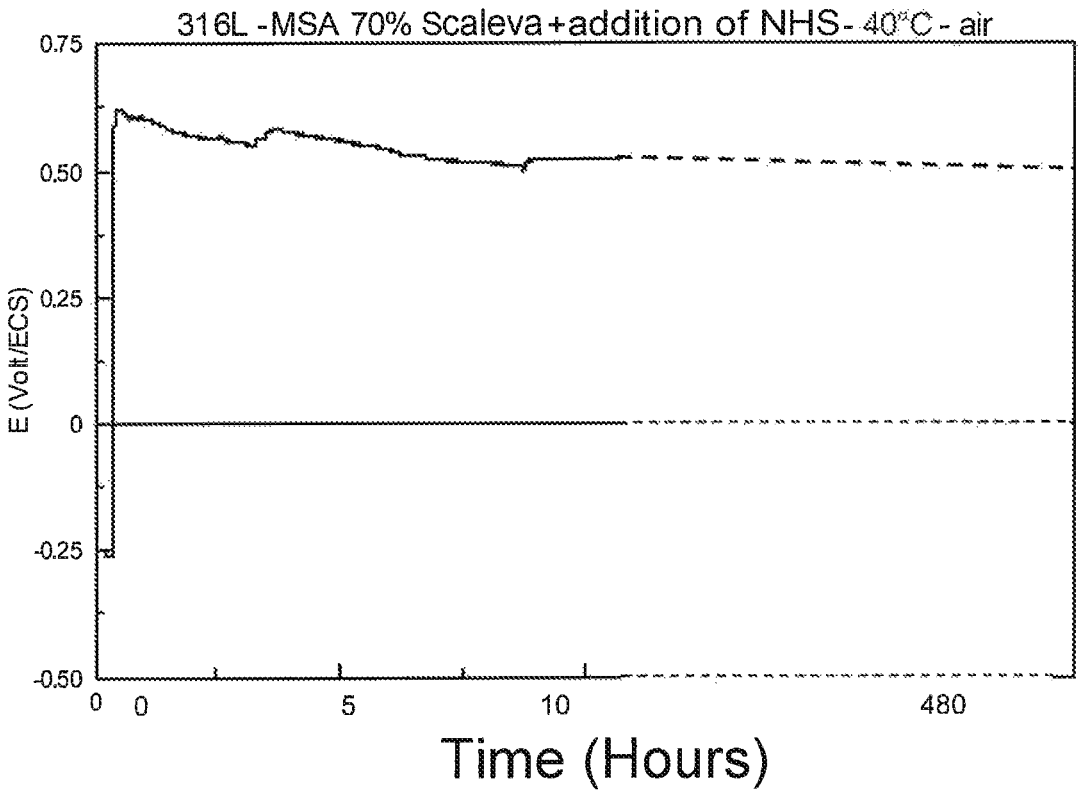
316L -MSA 70% Scaleva+addition of NHS- 40°C - air
0.75
0.50
0.25
0
-0.25
-0.50
E (Volt/ECS)
0
0
5
10
480
Time (Hours)

INHIBITORS OF METAL CORROSION

The present invention relates to the field of corrosion, by sulfonic acids, of metals and alloys which can be passivated, especially based on iron, nickel, titanium, copper, aluminium, molybdenum, manganese, lead, and alloys thereof, and also pairs of these metals or alloys obtained by contact (crimping, riveting, bolting, welding, brazing).

The subject of the invention is more particularly the protection of said metals from corrosion by sulfonic acids, and especially organosulfonic acids.

Sulfonic acids, more specifically organosulfonic acids, and in particular methanesulfonic acid (MSA), para-toluenesulfonic acid (PTSA), benzenesulfonic acid (BSA) and trifluoromethanesulfonic acid, are strong acids widely used in numerous applications, especially in catalysis and surface treatment (galvanoplasty, stripping, cleaning, descaling, and the like).

However, it has been observed that aqueous solutions of such sulfonic acids corrode metals, the corrosion rates depending simultaneously on the acid concentration, on the temperature and on the nature of the metal. For example, at ambient temperature, stainless steel of 304L or 1.4307 type is corrodible at MSA concentrations greater than 5% by weight in water. Such corrosion risks are unacceptable in many applications, and particularly for the storage of these acids mainly when they are in aqueous solution.

In order to protect stainless steels from corrosion by sulfonic acids (in particular PTSA and poly(styrenesulfonic) acid), it was proposed in patent application JP 07-278854 to add a copper salt to these acids. This document more particularly targets the protection of apparatus made of stainless steel (types AISI 304 and 316) used in workshops for synthesizing alcohols from olefins and water in the presence of a sulfonic acid as catalyst. The temperature range exemplified in this document extends from ambient temperature up to approximately 100° C.

In the paper entitled "*Corrosion of stainless steel during acetate production*", published in July 1996 in the review "Corrosion Engineering", vol. 2, no. 7, page 558, by J. S. Qi and J. C. Lester, it is indicated that the use of copper sulfate during esterification in the presence of sulfuric acid or para-toluenesulfonic acid makes it possible to considerably reduce the corrosion of the stainless steels AISI 304L and 316L.

However, these copper salts, which are corrosion inhibitors, have drawbacks: the static tests carried out on compositions of MSA and of copper(II) salts at temperatures of between 100° C. and 150° C. show that a thin layer of not very adhesive metallic copper forms at the surface of the materials tested (stainless steel AISI 304L and 316L). Indeed, during the implementation of this method on an industrial scale, sedimentation of metallic copper particles has been observed at the bottom of the reactor, which particles are capable of seriously damaging the recycling pumps or of adversely affecting the quality of the product produced. An additional filtration step is then necessary to eliminate these copper particles originating from the film deposited on the walls of the reactor.

In fact, during changes in operating conditions (for example temperature, pressure, stirring speed), this protective film becomes detached very easily. Moreover, heavy metals are defined as environmentally polluting and therefore the release of such types of compounds in effluents is problematic.

It has also been disclosed, in EP-A-0 931 654, that it is possible to inhibit the corrosion of stainless steels in organosulfonic medium, by adding at least one oxidizing agent chosen from salts or oxides of cerium(IV), of iron(III), of molybdenum(VI), of vanadium(V), nitrites and persulfates. In addition, B. Gaur and H. S. Srinivasan ("*British Corrosion Journal*", 34(1), (1999), 63-66) showed that the addition of ferric or nitrate ions makes it possible to produce an inhibitory effect on corrosion by MSA on various steels.

It can therefore be noted that the various inhibitors of corrosion of metals by sulfonic acids that are currently available, such as metal salts, are environmentally toxic. It is therefore highly desirable to be able to have inhibitors of corrosion of metals by sulfonic acids that are more effective, less toxic, and more environmentally friendly.

Some applications, in particular stripping and descaling use solutions based on MSA formulated with the addition of other products such as surfactants or agents that complex metal ions (sulfamic, citric or oxalic acid). The latter may cancel out the inhibitory effect of the oxidizing metal salts or lead to high doses of inhibitors which are not compatible with environmental friendliness.

It has now been found that it is possible, across a broad temperature range, to effectively protect metals, especially those mentioned above, such as ferric metals, copper, aluminium, and alloys thereof, and in particular steels, from corrosion by sulfonic acids, more specifically organosulfonic acids, preferably alkanesulfonic acids, more preferably still by MSA, by adding to the medium an effective amount of at least one compound chosen from nitrous acid or a compound capable of forming nitrous acid.

According to a first aspect, the present invention relates to the use of at least one compound of general formula (1):

$$O{=}N{-}OX \qquad (1),$$

in which X is chosen from:

- H;
- NO;
- a linear or branched alkyl radical R comprising from 1 to 6 carbon atoms;
- an aryl radical Ar which is optionally substituted, in particular by at least one alkyl radical R;
- a radical —$SO_2$-G, in which G represents H, OH, R, OR, OM, Ar, OAr, $NH_2$, NHR and NRR', in which R and Ar are as defined above, R' represents a linear or branched alkyl radical comprising from 1 to 6 carbon atoms and M represents a monovalent or bivalent metal cation, preferably an alkali metal or alkaline earth metal cation; and
- a radical —CO-G, in which G is as defined above, for limiting, or even preventing, the corrosion of metals by sulfonic acids.

When X represents a hydrogen atom, the compound of formula (1) is nitrous acid. When X represents —NO, the compound of formula (1) is nitrous anhydride.

According to a preferred embodiment of the present invention, X represents —$SO_2$-G, and more preferably still —$SO_2$-G in which -G represents —OH, in which case the corrosion inhibitor is nitrosylsulfuric acid (NHS; CAS no. 7782-78-7). According to another preferred aspect, X represents $SO_2$-G, in which G represents an alkyl radical R, preferably the methyl radical, in which case the corrosion inhibitor (CAS no. 117933-98-9) is the product of the reaction of methanesulfonic acid (or the chloride thereof) with nitrous acid.

In one embodiment, X is chosen from:

- NO;
- a linear or branched alkyl radical R comprising from 1 to 6 carbon atoms;

an aryl radical Ar which is optionally substituted, in particular by at least one alkyl radical R;

a radical —$SO_2$-G, in which G represents H, OH, R, OR, OM, Ar, OAr, $NH_2$, NHR and NRR', in which R and Ar are as defined above, R' represents a linear or branched alkyl radical comprising from 1 to 6 carbon atoms and M represents a monovalent or bivalent metal cation, preferably an alkali metal or alkaline earth metal cation; and a radical —CO-G, in which G is as defined above.

The research by Y. Cètre ("Prévention et lutte contre la corrosion" [*Preventing and combating corrosion*], ISBN 2-88074-543-8, (2004), Presses polytechniques et universitaires romandes, Lausanne, C H, pp. 661-676) showed that the corrosion of stainless steel of type AISI 304L by 70% sulfuric acid may be inhibited due to the presence of nitrosylsulfuric acid (NHS), the presence of which is inherent to the process for synthesizing sulfuric acid.

NHS, which is therefore known to be an impurity inherent to the preparation of sulfuric acid is, in its pure form, a highly hygroscopic and unstable fluid that reacts violently with water and produces toxic emissions ($NO_x$) in the presence of moisture.

Yet other derivatives of nitrous acid, and also nitrous acid itself, are unstable just like NHS.

In addition, it is well known to those skilled in the art specializing in metal corrosion that corrosion inhibitors are specific to one acid. For example, the corrosion inhibitors described in the literature which are effective in protecting stainless steels in sulfuric acid are ineffective for phosphoric acid and increase the rate of corrosion in hydrochloric acid. Conversely, the inhibitors of corrosion by hydrochloric acid are entirely unsuitable for sulfuric acid.

The research work of the present inventors made it possible to discover that some nitrosyl derivatives have an inhibitory activity on the corrosion of metals by sulfonic acids, and more particularly by organosulfonic acids. The metals under consideration are more specifically steels, and in particular common stainless steels (for example of AISI 304L and AISI 316L type), but also more generally any stainless steel as defined in standard NF EN 10088-1.

Thus, according to another aspect, a subject of the invention is a composition comprising at least one compound of formula (1) as defined above and at least one sulfonic acid as defined above, preferably at least one organosulfonic acid, preferably at least one alkanesulfonic acid, more preferably still MSA.

Effective amount is intended to mean an amount of compound(s) of formula (1) of between 1 ppm and a few percent, for example 10%, preferably between 5 ppm and 1000 ppm, more preferably still between 10 ppm and 800 ppm, by weight relative to the total weight of the composition.

The present invention also relates to a process for protecting metals from corrosion by sulfonic acids, in particular metals and alloys that can be passivated, in particular those based on iron, nickel, titanium, copper, aluminium, molybdenum, manganese, lead, and alloys thereof, and also the pairs (in the galvanic sense) of these metals or alloys obtained by contact (crimping, riveting, bolting, welding, brazing), characterized in that the sulfonic acid coming into contact with said metals is a composition as defined above comprising at least one compound of formula (1) as defined above.

Said compounds of formula (1) are either commercially available or, when they are unstable, prepared according to known procedures or procedures available in the scientific literature, patent literature or online. When they are unstable, the compounds of formula (1) are advantageously prepared immediately before being added to the sulfonic acid or the composition containing same.

By way of example, nitrosylsulfonic acid (NHS) may be obtained according to various methods known to those skilled in the art, including sparging of a stoichiometric mixture of nitric oxide (NO) and nitrogen dioxide ($NO_2$) in oleum (mixture of $H_2SO_4$, $SO_3$). The NHS thus obtained in solution in oleum may then be directly added to the sulfonic acid, or the composition containing same.

Thus, at least one compound of formula (1) may be added to at least one sulfonic acid for which it is desired to limit, or even prevent, the corrosive effect on metals, according to any method known per se, by simple addition and optional mixing.

According to one alternative, the compound of formula (1) may be generated in situ by adding a precursor of the compound of formula (1), which, on contact with the sulfonic acid(s), is converted into said compound of formula (1). Thus, for example, the compound O═N—$OSO_2CH_3$ (CAS reg. no. 117933-98-9) may be prepared by addition of a nitrogen oxideinitrogen dioxide mixture to methanesulfonic acid.

In the present invention, sulfonic acid is preferentially intended to mean the acids of formula R—$SO_3H$, in which R represents a linear or branched saturated hydrocarbon-based chain comprising from 1 to 4 carbon atoms, or an aryl radical optionally substituted by a linear or branched saturated hydrocarbon-based chain comprising from 1 to 4 carbon atoms and optionally entirely or partially substituted by one or more identical or different halogen atoms.

The linear or branched saturated hydrocarbon-based chain comprising from 1 to 4 carbon atoms may be entirely or partially substituted by one or more halogen atoms chosen from fluorine, chlorine and bromine, and in particular the hydrocarbon-based chain may be perhalogenated, more particularly perfluorinated.

The term "aryl" is intended to mean an aromatic radical, preferably a phenyl or naphthyl radical, more preferentially a phenyl radical.

Thus, and in a non-limiting manner, the sulfonic acids included in the context of the present invention are organosulfonic acids, preferably chosen from methanesulfonic acid, ethanesulfonic acid, n-propanesulfonic acid, iso-propanesulfonic acid, n-butanesulfonic acid, iso-butanesulfonic acid, sec-butanesulfonic acid, tert-butanesulfonic acid, trifluoromethanesulfonic acid, para-toluenesulfonic acid, benzenesulfonic acid, and mixtures of two or more thereof in any proportions.

According to a most particularly preferred embodiment, the sulfonic acid used in the context of the present invention is methanesulfonic acid, ethanesulfonic acid, trifluoromethanesulfonic acid or para-toluenesulfonic acid; entirely preferably, the sulfonic acid used is methanesulfonic acid.

The compositions according to the present invention comprising at least one sulfonic acid and an effective amount of at least one corrosion inhibitor of formula (1) are acid compositions that may be used in any field in which said sulfonic acids are commonly used. As indicated above, the acid compositions according to the invention have the advantage of being less corrosive, or even non-corrosive, compared to the same acid compositions not comprising corrosion inhibitor(s).

The compositions according to the present invention may be of any type: liquid, in more or less dilute aqueous solutions, or else in the form of gels or of foaming gels, the viscosities of which may vary within large proportions.

According to one embodiment, the compositions according to the present invention are used in pure form or diluted using various components, as indicated below.

As a general rule, the compositions comprise from 0.01% to 100% by weight of sulfonic acid(s) in combination with at least one corrosion inhibitor of formula (1) defined above, more generally from 0.05% to 90% by weight, in particular from 0.5% to 75% by weight, relative to the total weight of said composition, the remainder of the composition comprising a solvent and/or a diluant, preferably an aqueous diluant and/or solvent, more preferably still water, and optionally one or more additives as defined below in the present description.

According to a preferred embodiment, the composition of the present invention comprises at least one sulfonic acid chosen from methanesulfonic acid, ethanesulfonic acid, n-propanesulfonic acid, iso-propanesulfonic acid, n-butanesulfonic acid, iso-butanesulfonic acid, sec-butanesulfonic acid, tert-butanesulfonic acid, trifluoromethanesulfonic acid, para-toluenesulfonic acid, benzenesulfonic acid and mixtures of two or more thereof in any proportions, preferably from methanesulfonic acid, ethanesulfonic acid, trifluoromethanesulfonic acid and para-toluenesulfonic acid, entirely preferably methanesulfonic acid, in combination with at least one corrosion-inhibiting compound of formula O═N—OX, in which X is chosen from H, NO, a linear or branched alkyl radical R comprising from 1 to 6 carbon atoms and a radical —$SO_2$-G or —CO-G, in which G represents OH or R as defined above, the sulfonic acid and corrosion inhibitor combination representing from 0.05% to 90% by weight, in particular from 0.5% to 75% by weight, of the total weight of said composition, the remainder of the composition being water.

According to a most particularly preferred embodiment, the composition of the present invention comprises methanesulfonic acid, nitrosylsulfonic acid and water.

The compositions according to the present invention may optionally comprise one or more additives or auxiliary substance commonly s used in the field in question and according to the targeted applications.

Examples of additives and auxiliary agents comprise, non-limitingly, viscosity modifiers, rheology modifiers, foaming agents, anti-foams, surfactants, and the like, disinfectants, biocides, stabilizers, oxidizing agents, enzymes, pigments, dyes, fire retardants, flame retardants, and the like.

Thus, according to the envisaged uses, and if desirable or necessary, the compositions according to the invention may thus comprise one or more additives, such as those chosen from:

- solvents, hydrotropic or solubilizing agents (for example alcohols, esters, ketones, amides, and the like);
- biocides, disinfectants (bromoacetic acid, peracetic acid, aqueous hydrogen peroxide, chlorine dioxide, chlorine, bromine and the like);
- rheological, texturing, thickening or gelling agents (sugars, polysaccharides, alginates, silica, amorphous silica, gums, and the like);
- complexing agents;
- organic or inorganic acids (for example sulfuric acid, phosphoric acid, nitric acid, sulfamic acid, acetic acid, citric acid, ascorbic acid, formic acid, lactic acid, glycolic acid, oxalic acid, and the like);
- flame retardants;
- preservatives;
- anionic, cationic, non-ionic or amphoteric surfactants (such as ethoxylated alcohols and/or amines, alkyl and/or aryl sulfonates), emulsifiers, detergents, soaps, and the like;
- foaming agents, anti-foams;
- antifreezes (for example ethylene glycol, propylene glycol, and the like);
- dyes, pigments;
- fragrances, odorizing agents;

and other additives known to those skilled in the art.

Among the complexing agents optionally present in the compositions according to the invention, mention may especially be made of agents that complex metals, for example organic complexing agents, such as ethylenediaminetetraacetic acid (EDTA), diethylenetriaminepentaacetic acid (DTPA), (2-hydroxyethyl)ethylenediaminetriacetic acid (HEDTA), methylglycinediacetic acid (MGDA) or else nitrilotriacetic acid (NTA).

According to a preferred embodiment of the invention, the compositions may comprise one or more other organic or inorganic acids, among which mention may be made, by way of nonlimiting examples, of phosphoric acid, sulfuric acid, nitric acid, carboxylic acids such as sulfamic acid, citric acid, oxalic acid, glycolic acid, acetic acid, ascorbic acid, formic acid, lactic acid and the mixtures of two or more thereof in any proportions.

Among the solubilizing or hydrotropic agents that can be used in the formulations according to the invention, mention may be made, by way of example and in a nonlimiting manner, of sodium cumene sulfonate or sodium xylene sulfonate. However, such agents are not essential in the compositions of the invention.

The amounts of additives and/or auxiliary agents in the compositions of the invention may vary within large proportions and will be readily adjusted by those skilled in the art according to the specific applications envisaged.

Generally, the compositions according to the present invention are in the form of an aqueous, organic or else aqueous-organic formulation, which may be prepared in the form of a concentrated mixture, which concentrate may be diluted with water by the end user. As a variant, the formulation can also be a ready-to-use formulation, that is to say that it does not need to be diluted.

According to another aspect, the compositions of the present invention may be formulated in the form of gels or foaming gels.

In the case of formulations in gel form, or even in foaming gel form, the use of at least one ethoxylated amine oxide, such as, in a nonlimiting manner, Cecajel® OX100 from CECA, or Aromox® T12 from Akzo, alone or in combination with at least one dimethylalkylamine oxide, makes it possible to provide the gel, in particular the foaming gel, with stability.

An aqueous, organic or aqueous-organic formulation, in the form of a solution or a gel or else in the form of a foaming gel, that is particularly preferred is a formulation comprising from 0.01% to 97%, preferably from 0.05% to 75%, more preferably still from 0.5% to 70% by weight of methanesulfonic acid, combined with at least one compound of formula (1) as defined above.

According to the field and the method of application, the formulation can be prepared in the form of a concentrate, with a suitable viscosity, and then diluted before use until the expected effectiveness is obtained, with regard to the viscosity and optionally to the foaming capacity.

The compositions of the present invention may for example be prepared from commercial acid solutions and by way of nonlimiting examples from methanesulfonic acid in aqueous solution, sold by Arkema under the name Scaleva®, or else under the name Lutropur® sold by B.A.S.F, ready to use or diluted with water in the proportions indicated above.

According to one aspect of the present invention, the compositions comprising at least one sulfonic acid and at least one corrosion inhibitor of formula (1) as defined above also comprise a disinfectant, in particular chlorine dioxide.

According to a preferred embodiment, the chlorine dioxide may be generated in situ by addition of sodium chlorite to the composition of the invention. Sodium chlorite, on contact with a sulfonic acid, such as for example MSA, is converted to chlorine dioxide, a disinfectant, as indicated in patent application WO 2002/46095.

The compositions according to the present invention also comprising a disinfectant as indicated above have most particularly beneficial applications for cleaning and disinfecting cooling water circuits, disinfecting sanitation water and disinfecting hospital equipment.

According to another aspect, the compositions according to the invention have a most beneficial use in storing sulfonic acids, or solutions, in particular aqueous solutions, of sulfonic acids. Indeed, the presence, in said compositions of the present invention, of at least one corrosion-inhibiting agent, makes it possible to dispense with plastic coating films which are generally used for the storage of said acids in metal tanks, in particular in stainless steel tanks.

Another advantage of the compositions according to the present invention is their very good storage stability, and also their very good temperature stability. Thus, the compositions of the invention, which may be used in many fields of application, may in particular be used in chemical reactions requiring the use of sulfonic acids and which are carried out in metal reactors at temperatures for example between −10° C. and 200° C.

More generally, the compositions according to the present invention have applications in all fields in which acid compositions are required, especially aqueous acid solutions that come into contact with the metals mentioned above and in which it is desired to limit or prevent corrosion.

Such fields of application are, for example and nonlimitingly, storage, catalytic reactions (such as esterification reactions using acid catalysis), cleaning, descaling, detergency, stripping, galvanoplasty, plating (especially in the field of electronics), and the like.

By way of nonlimiting examples, the fields of application are stripping, cleaning, descaling and detergency of inorganic and/or organic soiling in food-processing industries such as dairies, cheese-making facilities, grocery and meat product packaging, breweries, and also the stripping, cleaning and descaling of inorganic residues in cement works, in all domains where it is necessary and desirable to eliminate rust, or else in oil and gas operations where acid solutions are necessary for dissolving underground rock, in particular carbonate-based rock.

The fields of application targeted by the compositions according to the present invention are all the fields in which at least one sulfonic acid is stored or conveyed in containers, barrels, tanks, receptacles, reactors, fermenters, lines, pipes, tubes, valves, which are capable of being corroded and in which it is desired to limit, or even prevent, corrosion.

According to another aspect, the present invention relates to the use of a composition comprising at least one sulfonic acid and at least one inhibitor of corrosion by said sulfonic acid(s) as defined above for the storage of said acids, catalytic reactions or else cleaning, descaling, detergency, stripping, disinfection, galvanoplasty, plating, and the like, at temperatures ranging from −10° C. to 200° C., preferably from 0° C. to 160° C.

The compositions according to the present invention, whether they are in liquid, gel or foaming gel form, concentrated or diluted, can be applied according to any method known to those skilled in the art, and in particular under pressure, or else by means of a spray gun.

As previously indicated, the sulfonic acid comprising the corrosion inhibitor defined above is advantageously used in the form of a formulation, for example an aqueous, organic or aqueous-organic formulation, in liquid, gel or foaming gel form, as previously described.

The present invention is now illustrated by means of the examples which follow, which are in no way limiting in nature, and which consequently cannot be understood as able to restrict the scope of the invention as claimed.

EXAMPLE 1

Protocols for Electrochemical Tests

The electrochemical test is carried out using a conventional 3-electrode assembly (reference electrode (saturated calomel electrode SCE), working electrode made of the material to be studied and counter electrode made of platinum) connected to a BIOLOGIC VMP3 or EGG 273A potentiostat.

The test specimen of material to be tested is polished with P1000 abrasive paper in order to have a reproducible initial state, then left in the open air for at least 24 hours.

The working electrode is installed in a rotary system which makes it possible to set the rotation speed: the rotation speed is set at 1000 revolutions per minute.

Several types of test using this assembly were used during this study:

- Potentiokinetic or voltammetric) sweep I=f(E): variation of the potential E of the material and measurement of the current I between the material and the counter electrode makes it possible to estimate the behaviour of the material in the medium: quality of the passive layer, estimation of the corrosion rate (Tafel method at free corrosion potential and direct reading of the current measured at other potentials), etc.
- Monitoring the rest potential (or potential-time curve) of the material as a function of time E=f(t): monitoring the rest potential of a stainless material makes it possible to determine if the material is passive (negligible corrosion) or active (passive layer destroyed, significant corrosion), as long as the potentiokinetic polarization curve has been plotted beforehand. This type of test also makes it possible to monitor the behaviour of the material as a function of the conditions present in the medium: influence of deaeration, of temperature, of addition of inhibitors, etc.

EXAMPLE 2

Electrochemical Test Showing the Persistence of the Effect of the Inhibitor

The long-lasting effect of the inhibition by NHS in 70% MSA (Scaleva®, Arkema) is demonstrated by monitoring the corrosion potential as a function of time at 40° C.

A test specimen of stainless steel 316L, of dimensions 35×23×3 mm is in the standard state (polished P320 and passivated with air for at least 24 hours).

During the immersion in 70% MSA at 40° C., the test specimen of stainless steel 316L depassivates immediately (potential of approximately −250 mV/SCE).

The addition of 400 ppm of NHS into the medium passivates the stainless steel 316L of the test specimen: the potential becomes greater than 500 mV/SCE.

After 21 days in these conditions, the 316L is still passive (potential greater than 500 mV/SCE), FIG. 1 presents the passivation curve as a function of time: at the time t=0, the stainless steel 316L test specimen is immersed in a 70% MSA solution (Scaleva®, Arkema) at 40° C. The stainless steel 316L becomes active as soon as it is immersed. At t=1200 seconds, 400 ppm of NHS (via a solution at approximately 60% of NHS in sulfuric acid) are added by means of an automatic micropipette to the acid solution at 40° C. The stainless steel 316L passivates immediately.

The nitrosylsulfonic acid used here is a solution at 60% by weight in sulfuric acid, prepared by sparging a 1/1 stoichiometric mixture of nitric oxide (NO) and of nitrogen dioxide ($NO_2$) (70 g and 110 g, respectively), in 830 g of oleum (mixture of $H_2SO_4/SO_3$: 77/23 by weight).

After 21 days, the steel test specimen is still passivated, indicating an absence of corrosion, even after this period of time.

EXAMPLE 3

Persistence, of the Inhibitory Effect Despite Worsening of the Test Conditions (Temperature Effect: 90° C.)

This test consists in monitoring the corrosion potential as a function of time:

The freshly polished sample of stainless steel 316L is immersed in 70% MSA Scaleva®+100 ppm of NHS at 40° C.: the sample passivates immediately.

The temperature of the medium is gradually increased by increments of 10° C.: after 5 days, the medium is at 90° C.: the stainless steel 316L is still passive.

After 460 hours (approximately 19 days), the sample is still passive.

The invention claimed is:

1. A composition, in the form of an aqueous formulation, comprising at least one sulfonic acid and at least one compound of formula (1)

$$O{=}N{-}OX \quad (1)$$

in which X is chosen from:

NO;

a linear or branched alkyl radical R comprising from 1 to 6 carbon atoms;

an aryl radical Ar which is optionally substituted by at least one alkyl radical R;

a radical —$SO_2$-G, in which G represents H, OH, R, OR, OM, Ar, OAr, $NH_2$, NHR and NRR', in which R and Ar are as defined above, R' represents a linear or branched alkyl radical comprising from 1 to 6 carbon atoms and M represents a monovalent or bivalent metal cation; and a radical —CO-G, in which G is as defined above, wherein the compound is in an amount effective for limiting, or even preventing, the corrosion of metals by sulfonic acids.

2. The composition according to claim 1, wherein the amount of compound(s) of formula (1) is between 1 ppm and 10%, by weight relative to the total weight of the composition.

3. The composition according to claim 1, comprising from 0.01% to 100% by weight of sulfonic acid(s) in combination with at least one compound of formula (1), and the remainder of the composition comprising a solvent and/or a diluant.

4. The composition according to claim 1, comprising at least one sulfonic acid chosen from methanesulfonic acid, ethanesulfonic acid, n-propanesulfonic acid, iso-propanesulfonic acid, n-butanesulfonic acid, iso-butanesulfonic acid, sec-butanesulfonic acid, tert-butanesulfonic acid, trifluoromethanesulfonic acid, para-toluenesulfonic acid, benzenesulfonic acid or mixtures thereof and where the compound of formula O═N—OX includes X chosen from NO, a linear or branched alkyl radical R comprising from 1 to 6 carbon atoms and a radical —$SO_2$-G or —CO-G, in which G represents OH or R as defined above, and wherein the sulfonic acid and corrosion inhibitor are present in amounts from 0.05% to 90% by weight of the total weight of said composition, the remainder of the composition being water.

5. The composition according to claim 1, comprising methanesulfonic acid, nitrosylsulfuric acid and water.

6. The composition according to claim 1, also comprising one or more additives chosen from:

solvents, hydrotropic agents or solubilizers, biocides, disinfectants, rheological agents, texturing agents, thickeners, gelling agents, complexing agents;

organic or inorganic acids;

flame retardants, preservatives, anionic, cationic, non-ionic or amphoteric surfactants, emulsifiers, detergents, soaps, foaming agents, antifoams, antifreezes, dyes, pigments; and fragrances, odorizing agents.

7. The composition according to claim 1 wherein the sulfonic acid is alkanesulfonic acid.

8. The composition according to claim 1 wherein the sulfonic acid is MSA.

9. A process for protecting metals from corrosion by sulfonic acids, in particular metals and alloys which can be passivated, comprising contacting said metals with the composition according to claim 1.

10. The process according to claim 9, in which the metal is chosen from iron-based or nickel-based stainless steels or alloys, titanium, copper, aluminium, molybdenum, manganese, lead and alloys thereof, and also the pairs (in the galvanic sense) of these metals or alloys.

11. In a process for storage, catalytic reactions cleaning, descaling, detergency, stripping, disinfection, galvanoplasty, or plating where metal is contacted with acid at temperatures ranging from −10° C. to 200° C. where the improvement comprises contacting the metal with the composition according to claim 1.

12. The process according to claim 11, includes, cleaning, descaling and detergency of inorganic and/or organic soiling in food-processing industries such as dairies, cheese-making facilities, grocery and meat product packaging, breweries, and also the stripping, cleaning and descaling of inorganic residues in cement works, in all domains where it is necessary and desirable to eliminate rust, or oil and gas operations where acid solutions are necessary for dissolving underground rocks, in particular carbonate-based rocks.

13. The process according to claim 11, where the metal includes containers, barrels, tanks, receptacles, reactors, fermenters, lines, pipes, tubes, valves, in which at least one sulfonic acid is stored or conveyed.

* * * * *